US005478247A

United States Patent [19]

Chen et al.

[11] Patent Number: 5,478,247

[45] Date of Patent: Dec. 26, 1995

[54] ELECTRICAL CONNECTOR

[76] Inventors: Chou Lin Chen, 8, Wu Fu 4th St., Taoyuan; Hung Chih Shih, 3FL, No. 12, Alley 14, Lane 57, Fu He Rd., Houng He City, Taipei Hsien; Mon Shing Chang, 10, Alley 84, Lane 207, Show Tsai Rd., Yang Mei, Taoyuan; Din Kuen Wang, 12, Lane 254, Chine Hwa St., Taipei, all of Taiwan

[21] Appl. No.: 209,610

[22] Filed: Mar. 10, 1994

Related U.S. Application Data

[63] Continuation of Ser. No. 976,873, Nov. 16, 1992, abandoned.

[30] Foreign Application Priority Data

Nov. 14, 1991 [JP] Japan ..... 3-093544 U

[51] Int. Cl.[6] ..... H01R 9/09

[52] U.S. Cl. ..... 439/65; 439/326

[58] Field of Search ..... 439/152–160, 439/326–328, 630–637, 59, 62, 65, 79

[56] References Cited

U.S. PATENT DOCUMENTS

| | | | |
|---|---|---|---|
| 3,737,833 | 6/1973 | Jerominek | 439/61 |
| 4,995,825 | 2/1991 | Korunsky et al. | 439/326 |
| 5,041,005 | 8/1991 | McHugh | 439/326 |
| 5,046,955 | 9/1991 | Olsson | 439/326 |
| 5,061,201 | 10/1991 | Tuan | 439/326 |
| 5,094,624 | 3/1992 | Bakke et al. | 439/326 |
| 5,100,337 | 3/1992 | Lee Chao | 439/326 |
| 5,161,994 | 11/1992 | Sato et al. | 439/326 |

*Primary Examiner*—David L. Pirlot

*Attorney, Agent, or Firm*—Woodcock Washburn Kurtz Mackiewicz & Norris

[57] ABSTRACT

An electrical connector which has improved durability is provided. The housing of the connector has a first surface mounted on a mother board and a second surface on which a daughter board is mounted and which is disposed opposed to the first surface. On both ends of the first surface mounting legs are provided for receiving an edge of the mother board. On both ends of the second surface latch members for holding the daughter board and stoppers slightly spaced from the latch members are provided. When the daughter board is mounted on the connector, the latch members are prevented from being flexed excessively due to the contact of the latch members with the stop members. The daughter board and the connector are arranged in series and connected to each other such that the height of the assembly of the daughter board and the connector is lowered.

13 Claims, 8 Drawing Sheets

ELECTRICAL CONNECTOR

This is a continuation of application Ser. No. 07/976,873, filed Nov. 16, 1992, now abandoned.

BACKGROUND OF THE INVENTION

1. Field of the Invention

This invention relates to an electrical connector for electrically Connecting together printed circuit boards or the like.

2. Description of the Related Art

In a system including printed circuit boards, many extension boards or daughter boards are electrically connected to a mother board for a system extension purpose.

The electrical connector is mounted on the mother board and has an insulating housing in which a recess for receiving one edge of the daughter board.

When the daughter board is connected to the mother board, the edge of the daughter boards is inserted slantwise with respect to the surface of the mother board in the recess of the housing. Then, the daughter board is rotated to take a normal posture with respect to the surface of the mother board. The edge of the daughter board taking the vertical posture is held between the contacts in the recess by their spring forces so as to be electrically connected to the contacts.

A pair of latch members are integrally formed on both ends of the housing in order to fixedly set the daughter board in the vertical posture. Each latch member is extended outwardly of the housing so as to be flexed by means of the daughter board during the rotational movement of the daughter board. When the daughter board takes the vertical posture, the latch members return to the initial state such that the daughter board is held at its lateral edges. At the same time, the surfaces of the daughter board are held by latch members and the daughter board is fixed to take the vertical posture. In order to take the fixed daughter board out of the connector device, the paired latch members are flexed outwardly.

Since, however, the latch members as well as the housing is made of plastics, it is likely to be cracked, chipped or broken, leading to insufficient durability. When the attachment and detachment of the daughter board integrally connected to the housing are repeated many times, the latch members are apt to be bent beyond the elastic deforming limit and fatigue occurs in the bending portions of the latch members, gradually hindering the latch members from returning to the initial state. This lowers the holding forces of the daughter boards and makes it difficult to connect the daughter boards to the connecting terminals. It occurs sometimes that the latch members are broken or cut off.

SUMMARY OF THE INVENTION

An object of this invention is to provide an electrical connector including latch means having improved durability.

When the electrical connector is used in personal computers, laptop computers or notebook type personal computers, it is required that the connector be low in height and small in size. Therefore, it is an additional object of this invention to provide a connector which has a low height and a miniaturized profile.

In one aspect of this invention, there is provided an electrical connector for electrically connecting a first circuit board to a second circuit board, comprising:

an insulating housing having a first surface mountable on the first circuit board and a second surface with a recess provided therein, the recess is dimensioned to receive one edge of the second circuit board therein, the second surface has a pair of supporting members for supporting the second circuit board to take a predetermined posture with respect to the first circuit board, the supporting posts being provided on the second surface so as to face each other and sandwich the recess;

a plurality contacts positioned in the recess for establishing an electrical interconnection to the second circuit board;

a pair of latching means for latching the second circuit board and for releasing the latching of the second circuit board, the latching means being provided on the second surface of the housing so as to face each other and sandwich the supporting members; and a pair of limiting means for limiting flexure of the latching means, the limiting means being provided on the second surface of the housing so as to face each other and sandwich the latching means. The latching means may be detachably provided on the housing.

The latching means may be a metal member which has the appropriate resident characteristics to allow the latching means to be used over many cycles.

The limiting means may be integrally formed with the metal member.

The housing may be molded from elastmeric material. The elastmeric material may be high temperature plastic.

The latching means and the limiting means are integrally mold-formed on the second surface of the housing.

According to one embodiment of this invention, the housing has at least two opposed mounting legs for mounting the housing on the first circuit board, the mounting legs are integrally mold-formed on the first surface of the housing. According to one embodiment of this invention, the mounting leg extends through a thickness of the first circuit board. Alternatively, the mounting leg may have a receiving portion for receiving one edge of the first circuit board. According to one embodiment of this invention, the one edge of the first circuit board received in the receiving portions of the mounting legs and the one edge of the second circuit board received in the recess of the housing are disposed opposed to each other with the housing interposed therebetween. The first surface of the housing may be substantially opposed to the second surface of the housing. The first surface of the housing is substantially perpendicular to the second surface of the housing. The second circuit board received in the recess of the housing makes an acute or dull angle or right angles with a direction in which the first circuit board extends. The second circuit board received in the recess of the housing may extend along a direction in which the first circuit board extends. In this case, the first circuit board may face the second circuit board. The housing may have at least two bumps which are provided so as to press the second circuit board received in the recess of the housing to allow the same to take the posture.

The connector according to this invention provides latch means having high durability, because the limiting means prevents excessive flexure of the latch means. Proper combinations of the arrangement of the two mount surfaces and the shape of the mounting legs allow for a low profile of the connector. In a case where the first and second surfaces of the housing are adapted to face each other, the use of the mounting legs for receiving the edge of the first circuit board hinders the first and second circuit boards from projecting in their thickness directions, enabling the height of the connector to be lowered.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

This invention will now be described by way of the preferred embodiments with reference to the accompanying drawings.

DETAILED DESCRIPTION OF THE PREFERRED EMBODIMENTS

Figure 1:
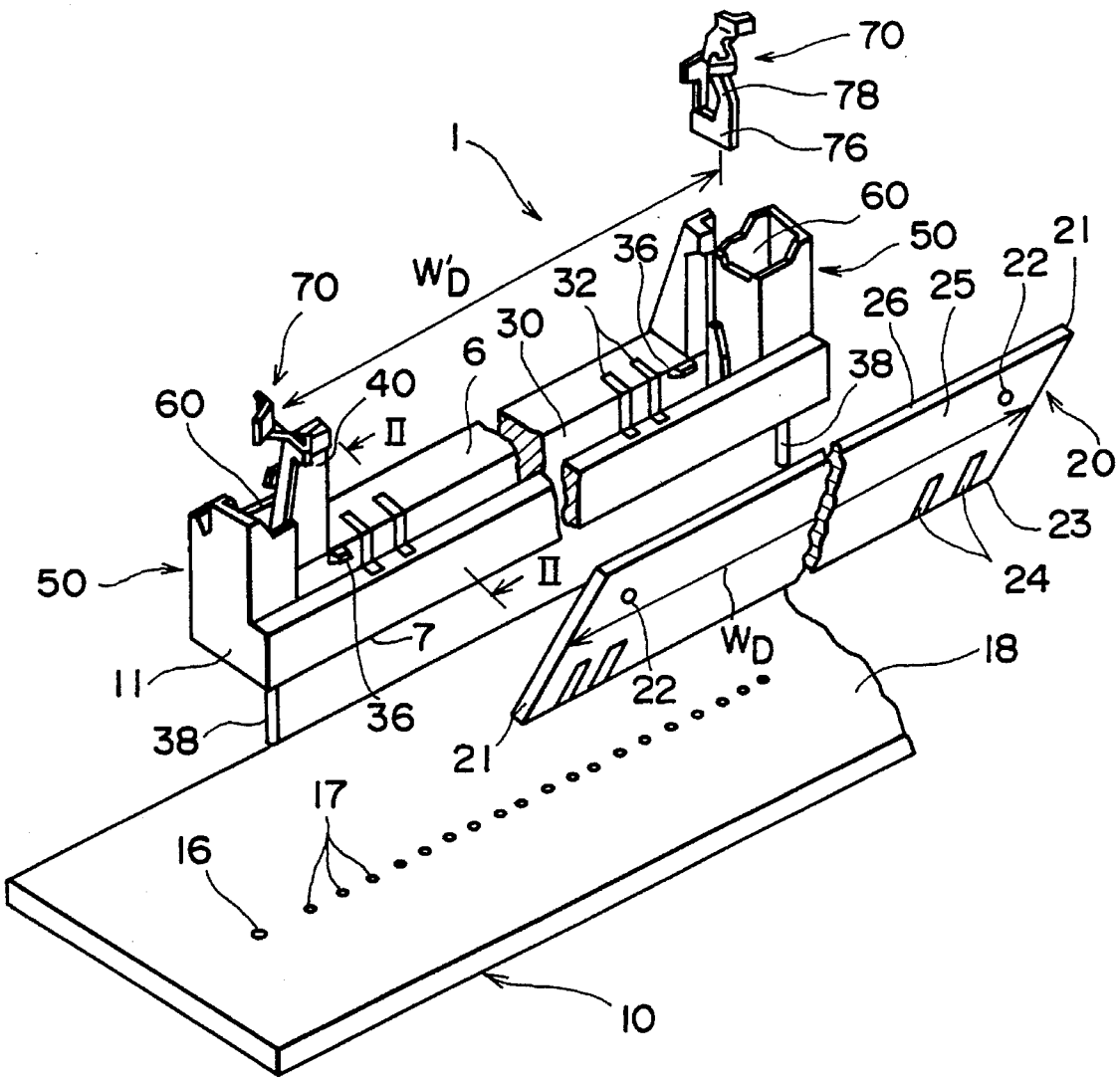
FIG. 1 is an exploded perspective view showing an electrical connector and two boards according to the first embodiment of this invention.

Referring to FIG. 1, an electrical connector 1 is mounted on a mother board 10 which is provided with a daughter board 20, such that the daughter board 20 is electrically connected to the mother board 10 by means of the connector 1. For instance, the mother board 10 may be memory control board and the daughter board 20 is a single-inline-memory module (SIMM).

In the mother board 10 a pair of holes 16 (only one being shown in FIG. 1) are formed for holding the connector 1 and a plurality of holes 17 for receiving solder tails (not shown in FIG. 1) of the contacts 32. The surface of the mother board 10 is designated at 18.

The daughter board 20 is formed with openings 22 at both ends and provided on the proximal side with soldering pads 24 arranged in series along the width direction of the daughter board 20. The outer surface and the rear surface of the daughter board 20 are indicated at 25 and 26, respectively.

The connector 1 has a housing 11 molded from electrically insulating elastmeric material which is preferably high temperature plastics capable of resisting heat produced by infrared rays and heat generated in a vapor-phase soldering step.

The housing is disposed such that a first surface 6 which is to be mounted on the mother board 10 faces a second surface 7 on which the daughter board 20 is mounted.

Figure 2:
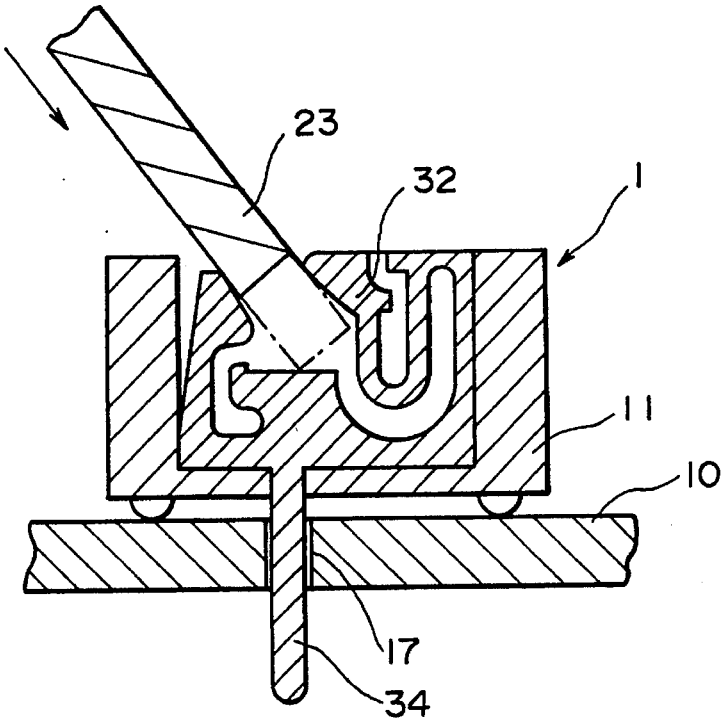
FIG. 2 is a cross-sectional view taken along line II—II in FIG. 1.

A lengthwise extending slot or recess 30 is formed in the first surface 6 of the housing 11. A plurality of contacts 32 are arranged in series on the housing 11 along the slot 30. The soldering pads 24 arranged on the daughter board 20 elastically contact the respective contact terminals 32 to be electrically connected thereto. As the contacts 32 used may, for example, be conventional elastic contacts for an SIMM as shown in FIG. 2.

Each contact 32 on the housing 11 is electrically connected to the mother board 10 by inserting solder tails 34 in the holes 17 of the mother board 10 (FIG. 2) or by using any other process.

Figure 3:
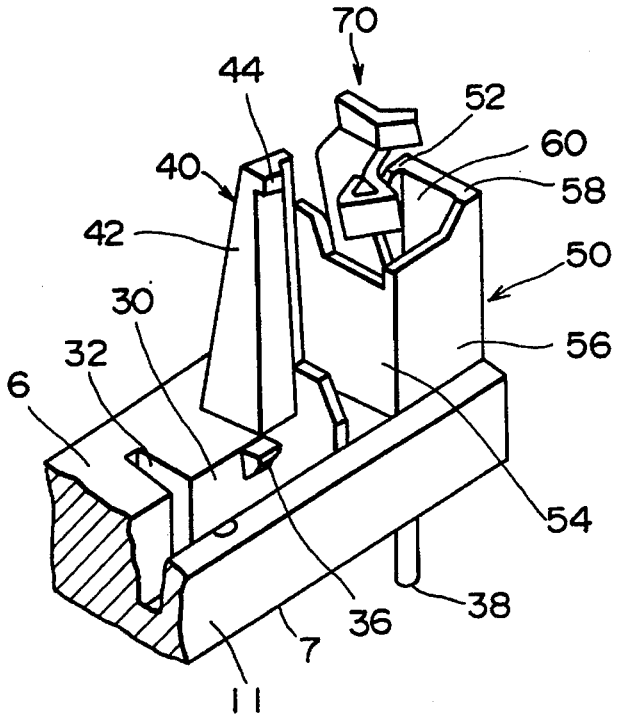
FIG. 3 is an enlarged perspective views of the housing of FIG. 1.

Bumps 36 are formed on both end portions of the slot 30, as shown particularly in FIG. 3, and are provided so as to contact the rear surface of the daughter board 20 inserted in the slot 30 and are used to prevent the distortion and the bending of the daughter board 20 when the daughter board 20 is held by latch members 70 as described later.

The housing 11 is provided on portions close to both ends of the slot 30 with supporting members 40, and on both ends of the housing 10 with pocket members 50. The supporting members 40 and the pocket members 50 are integrally mold-formed together with the housing 11.

The supporting members 40 are used to hold the daughter board 20 connected to the mother board 10 as described above when it takes a connecting posture and each of them includes a column 42, and a boss 44 extending from the top portion of the column 42 toward the inner side of the same. The bosses 44 engage the openings 22 (FIG. 1) of the daughter board 20 to hold the daughter board 20 in an installation position with respect to the connector 1.

Each pocket member 50 has a pocket 60 defined by a first wall 59., a second wall 54, a third wall 56 and a fourth wall 58 and receives the corresponding one of a pair of latch members 70 which are provided symmetrically on the housing 11.

Figure 4:
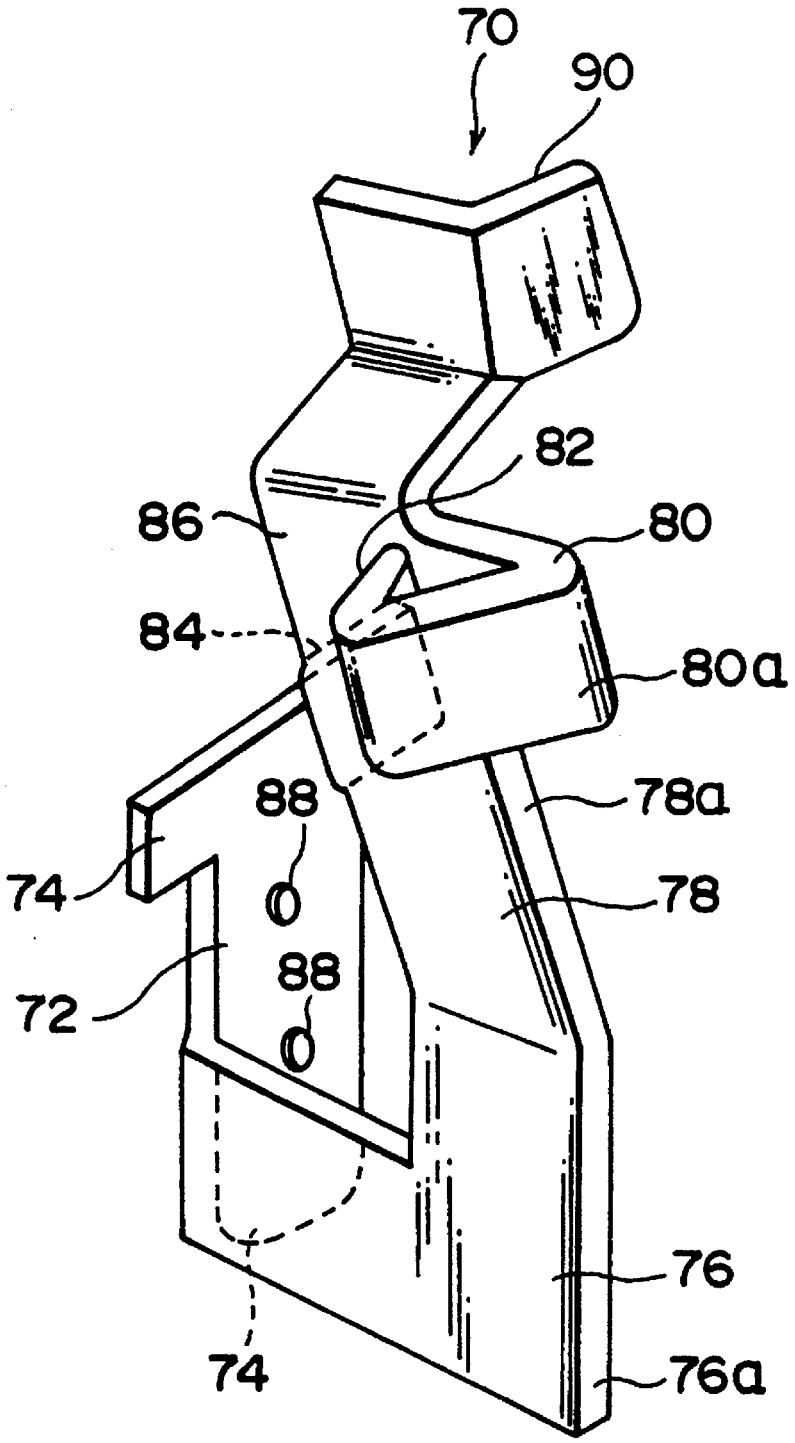
FIG. 4 is an enlarged perspective view of the latch members of FIG. 1.

As shown particularly in FIG. 4, each latch member 70 is formed as an integral member by stamping a metallic plate such as phosphor bronze or by using the like process. The latch member 70 has a fixed proximal end 72 which faces the first wall 52 (FIG. 3) of the corresponding pocket 60 and a free distal end 90. A retaining beam constituted by the proximal end 72 of the latch member 70 is provided on its both ends]with retaining tabs 74. A Supporting beam 76 extends from one lateral side of the retaining beam 72. A spring beam 78 extends from the =front end of the supporting beam 76. A fixing portion 80 extends from one lateral side of the spring beam 78 and has a fixing plate 82 which is adapted to contact the outer surface 25 (FIG. 1) of the daughter board 20. An overstress preventing tab or stopper 84 extends from the other lateral side of the spring beam 78. The free distal end 90 of the spring beam 78 forms an unlatching tab.

The latch members 70 are inserted in the pocket members 50 to allow the retaining tabs 74 to be fitted in the pockets 60 such that the latch members 70 are fixed to the housing 11.

The paired latch members 70 are disposed on both ends of the housing 11 so as to face each other (FIG. 1). Suppose that the daughter board 20 is inserted in the slot 30 and is in electrical contact with the contact terminals 32. Then, the paired spring beams 78 elastically hold the daughter board 20 at both lateral edges 21 thereof. For the purpose of holding the daughter board 20, the width $W_D'$ (FIG. 1) of the opposed faces 86 of the paired spring beams 78 is rendered slightly smaller than the width $W_D$ (FIG. 1) of the daughter board 20. In this embodiment, the spring beam 78 of each latch member 70 is bent at a suitable angle with respect to the corresponding supporting beam 76 such that the distance between the opposed faces 86 of the paired spring beams 78 is made small to obtain a required holding force.

It is preferred that a projecting portion 88 be formed on that portion of each latch member 70 which is in contact with the inner face of the first wall 52 of the pocket member 50, whereby the friction between the inner faces of the first walls 52 and the projecting portions 88 ensures further stronger connection of the latch members 70 to the housing 11.

It is preferred that the spring beams 78 of the latch members 70 be adapted to contact the inner faces of the second walls of the pocket walls 54. The friction generated between the spring beams 78 and the second walls 54 ensures the firm longitudinal connection between the latch members 70 and the housing 11.

In a state where the daughter board 20 is inserted in the slot 30 and held by the paired latch members 70, the elastic force of the contacts 32 in the slot 30 presses the daughter board 20 in the direction of its own thickness. The daughter board 20 must be fixed in order to resist this elastic force. The fixing portion 80 is provided on each latch member 70 for this fixing purpose.

The paired latch members 70 are arranged such that the fixing portions 80 lie on a plane (FIG. 1). The lateral side face 78*a* of the spring beam 78 of each latch member 70 and the lateral side face 76*a* of the corresponding supporting beam 76 of the latch member 70 lie on the same plane and the lateral side face 78*a* of each spring beam 78 is in contact with the inner face of the third wall 56 of the corresponding pocket member 50 such that the fixing faces 82 of the latch members 70 can support the daughter board 20 against the elastic forces of the contacts 32. In this regard, the daughter board 20 is fixed to the housing 11 so that it cannot move in its own thickness direction.

Preferably, the fixing portion 80 of each latch member 70 has a guide face 80*a* for guiding the daughter board 20 to the corresponding engaging member 40. The fixing portions are bent and inclined in such a way that the space between the outer ends of the paired guide faces 80*a* is rendered narrower than the space between the inner ends of the paired guide faces 80*a*. The contact of each guide face 80*a* with the lateral side edge of the daughter board 20 permits the latch members 70 to be displaced in the direction opposite to the direction of the elastic displacement for holding the daughter board 20.

Referring to FIG. 1 again, the connector 1 is mounted on the mother board 10 by means of the legs 38 which are integrally molded-formed together with the housing 11 and which are to be inserted in the holes 16 of the mother board 10.

In mounting the daughter board 20 on the connector 1 provided on the mother board 10, the proximal end 23 of the daughter board 20 is inserted slantwise in the slot 30 of the housing 11. When the daughter board 20 is rotated to a position at which the proximal ends 23 of the daughter board 20 is inserted in the slot 30, the lateral side edges 21 slide on the guide faces 80*a* of the latch members 70 and the spring beams 78 of the latch members 70 are flexed outwardly. After the lateral side edges 21 have passed the guide surfaces 80*a*, the paired spring beams 78 return to the initial positions and hold the daughter board 20 at its lateral side edges. In this case, the elastic forces of the spring beams 78 applied or the lateral side edges 21 of the daughter board 20 would act not only to hold the daughter board 20 but also to produce the distortion and bending of the daughter board 20, if means for preventing them is not provided. According to this invention, however, the bumps 36 in the slot 30 abut against the rear surface 26 of the daughter board 20 to support the daughter board 20, whereby the daughter board 20 is 10 prevented from being distorted or bent. The openings 22 of the daughter board 20 held by the spring beams 78 engage the bosses 44 of the supporting members 40 and the outer surface 25 of the daughter board 20 is supported by the fixing faces 82 of the latch members 70 such that the daughter board 20 takes an upright posture. In this way, the daughter board 20 is mounted on the connector 1 and is electrically connected to the mother board 10.

In order to remove the daughter board 20 from the connector 1, the unlatching tabs 90 of the latch members 70 are pushed outwardly of the housing 11. The spring beams 78 are turned outwardly of the housing 11 around the connecting portions of the supporting beams 76. The daughter board 20 is released and pushed by the elastic pressing forces applied by the contact terminals 32 to the position at which the daughter board 20 was disposed before it was inserted in the slot 30. Preferably, the unlatch tabs 90 have a Z shape as shown in FIG. 4 such that they are opened by pushing.

The overstress preventing tab 84 provides the resilient characteristics, required to insure for the proper and continued use of the latch member 70 over many cycles.

When the spring beams 78 are pushed to be extended, the overstress preventing tabs 84 abut against the fourth walls 58 of the pocket members 50, and thus the spring beams 78 are refrained from being flexed excessively and fatigued. The length of the tabs 84 is selected so as to accord with this purpose.

The capability of attaching the latch members 70 to and detaching the same from the pockets 60 facilitates the mounting of the daughter board 20 on the housing 11 and the replacement of the daughter board 20.

In this embodiment, the angle between the mother board 10 and the daughter board 20 is a right angle but may be an acute or dull angle.

Figure 5:
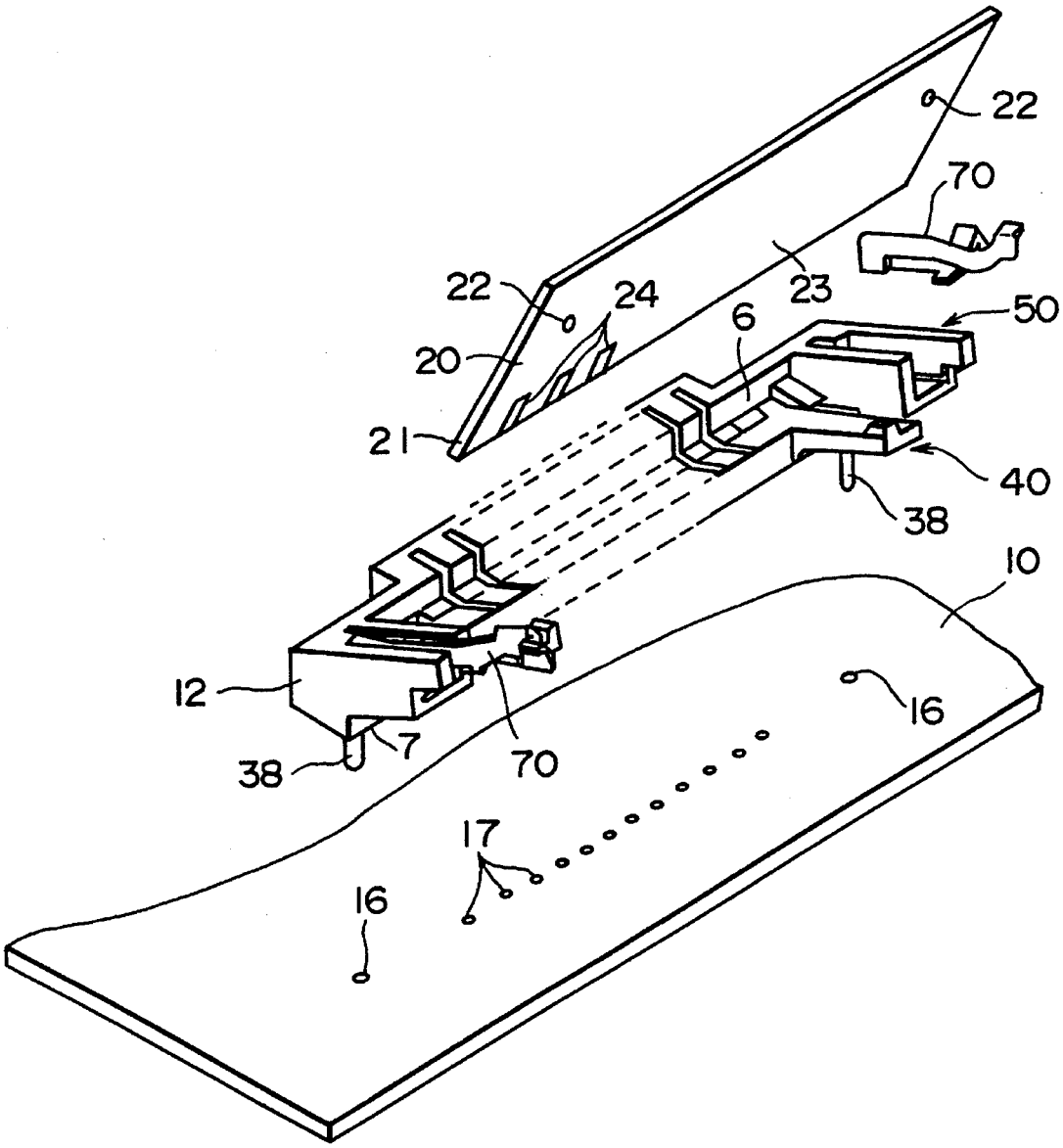
FIG. 5 is an exploded perspective view showing an electrical connector and two boards according to the second embodiment of this invention.

The second embodiment is shown in FIG. 5. The elements of the second embodiment which are the same as those in the first embodiment are designated by the same reference numerals. In the housing 12 of electrical connector 2, the daughter board 20 makes right angles with a mother board 10 so that the height of the connector 2 mounted on the mother board 10 can be lowered. The daughter board 20 can extend along the direction in which the mother board 10 extends. In this arrangement, the two boards 10 and 20 can be supported so as to face each other in such a manner that the overall height of the combined structure of the connector 2 and the two boards 10 and 20 can be lowered.

In the second embodiment, the third wall 56 of pocket members 50 is omitted.

Figure 6:
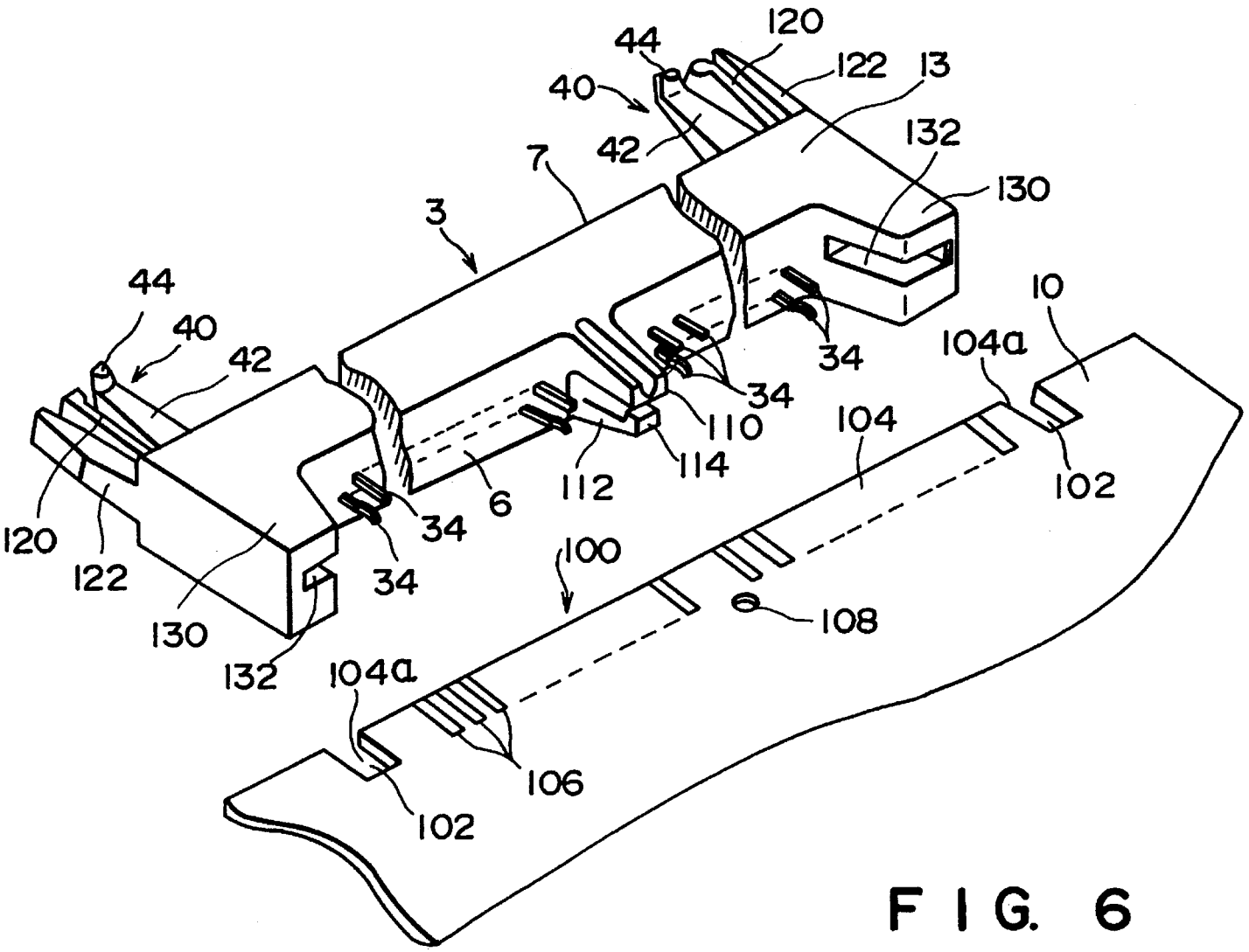
FIG. 6 is an exploded perspective view showing an electrical connector and a board according to the third embodiment of this invention.
Figure 7:
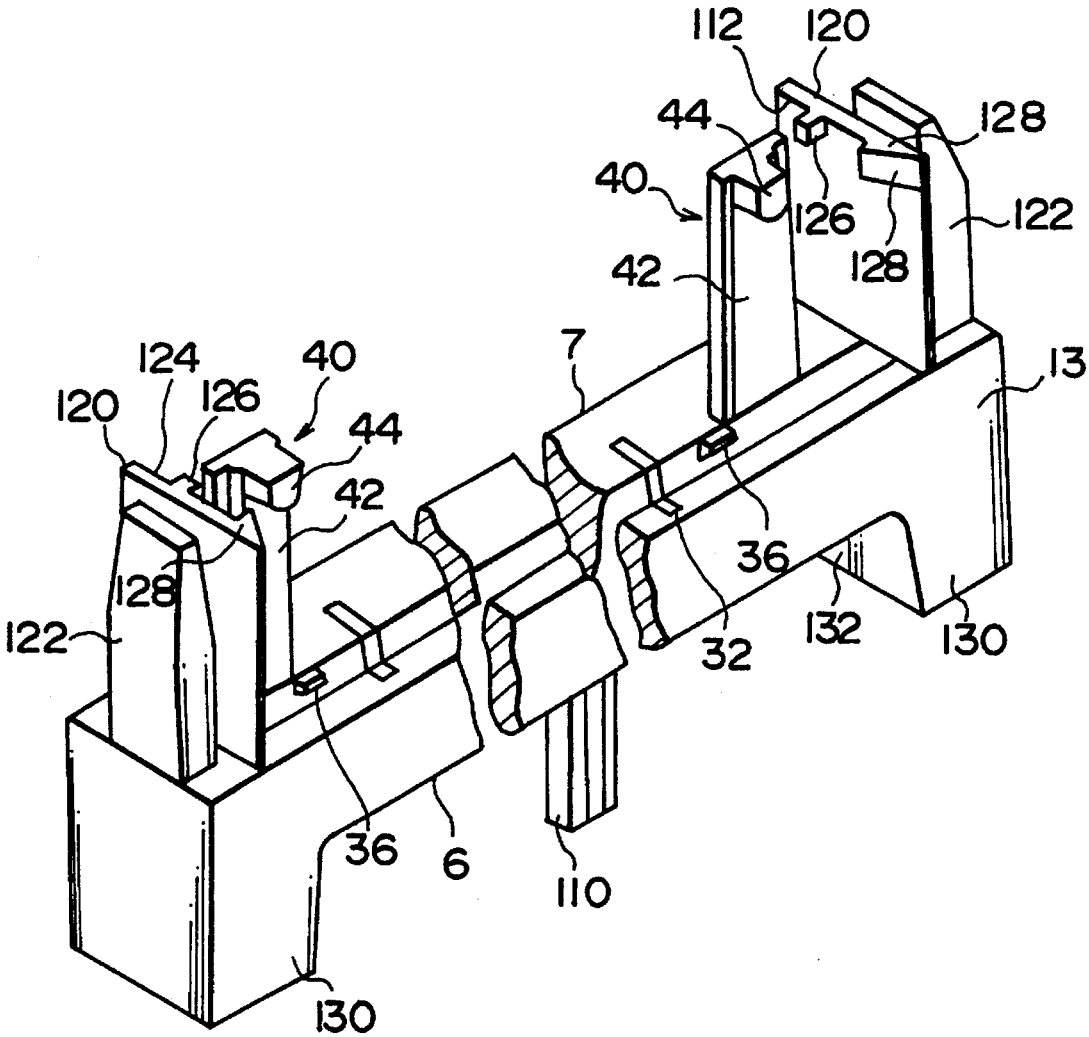
FIG. 7 is a perspective view of the connector of FIG. 6.

The third embodiment of this invention is shown in FIGS. 6 and 7. The elements of this embodiment which are the same as those of the first or second embodiments are depicted by the same reference numerals. An electrical connector 3 is mounted on an edge 100 of a mother board 10.

Notches 102 are formed in those portions of the mother board 10 which are close to both ends thereof. A plurality of soldering pads 106 are arranged on a shoulder 104 defined between the two notches 102 such that the pads 106 contact the contacts 32 of a connector device 2 (FIG. 2) when the connector 2 is mounted on the mother board 10. A hole 108 is formed in the central portion of the edge 100 of the mother board 10.

The housing 13 of the connector 3 has a first surface 6 and a second surface 7 which faces the first surface 6.

Mounting members 130 extend from both ends of the first surface 6 of the housing 13. In the inner face of each mounting member 130 is formed a groove 132 for receiving the lateral edge 104 of the shoulder 104 of the mother board 10.

An upper retaining member 110 and a lower retaining member 112 extends from the central portion of the first surface 6 of the housing 13. On the inner face of the lower retaining member 112 is formed a boss 114 engageable with the central hole 108 of the mother board 10.

The mounting members 130, the upper retaining member 110 and the lower retaining member 112 are integrally mold-formed together with the housing 13.

In order to mount the connector 3 on the mother board 10, the lateral edge 104a of the shoulder 104 of the mother board 10 is fitted in the grooves 132 of the paired mounting members 130, and the boss 114 of the lower retaining member 112 is inserted in the central hole 108 of the mother board 10. The Upper retaining member 110 is pushed against the surface of the mother board 10, urging the boss 114 into engagement with the central hole 108. The upper retaining member 110 also acts to keep an accurate distance between the solder tails 34 of contact terminals 32 and the soldering pads 106 of the mother board 10.

The structure of the second surface 7 of the housing 13 is the same as that of the first embodiment, except for a pair of latch members 120 and a pair of stop members 122. The latch members 120 are integrally mold-formed together with the housing 13 from plastics.

The latch members 120 are disposed opposed to each other with a pair of engaging members 40 disposed therebetween and formed with wall faces 124 which are to be abutted against the edge 21 of the daughter board Formed on each wall face 124 are a pair of projections 126 and 128 which hold the lateral edge 21 of the daughter board 20. The distance between the projections 126 and 128 corresponds to the thickness of the daughter board 20.

The surface 128*a* of the projection 128 which is located at the inserting side of the daughter board constitutes a tapered guide for guiding the daughter board 20 to the paired projections 126 and 128.

The latch members 120 must be arranged such that the distance between the opposed wall faces 124 is rendered slightly smaller than the width of the daughter board 20 in order that the daughter board 20, inserted in a slot 30 and erected, is held by elastic forces acting in the lengthwise direction of the daughter board 20., Integrally mold-formed on both ends of the second surface 7 together with the housing 13 are the paired stoppers 122 disposed opposed to each other with the paired latch members 120 interposed therebetween. In the third embodiment, the stop member 122 is a bar projecting from the housing 13. When the latch members 120 are flexed in the outer direction of the housing 13, i.e., in the direction in which the distance between the latch members 111 is enlarged, the stoppers 122 contact the latch members 120 to prevent excessive flexure of the latch members 120.

In order to mount the daughter board 20 on the connector 3 mounted on the mother board 10, the proximal end 23 of the daughter board 20 is inserted in the slot 30 slantwise at the side of the projections 126 of the latch members 120. After the proximal end 23 of the daughter board 20 has been inserted in the slot 30, the daughter board 20 is turned as shown in FIG. 1. The lateral edge 21 of the daughter board 20 slides on the guide face 128*a* and flexes the latch members 120 outward. When the lateral edge 21 of the daughter board 20 reaches the space between the projections 126 and 128, the latch members 120 elastically regain the initial shape and hold the daughter board 20 at both its lateral edges such that the daughter board 20 takes a vertical posture. In this way, the daughter board 20 is mounted on the connector 3 and is electrically connected to the mother board 10.

In order to detach the daughter board 20 from the connector 3, the paired latch members 120 are pushed to make the distance therebetween larger. The wall faces 124 are flexed outwardly in the lengthwise direction of the housing 13 and the daughter board 20 becomes free from the holding forces. The daughter board 20 is pushed out by the elastic pressing force of the contacts 32 to the initial position at which the daughter board 20 was disposed before insertion.

When the latch members 120 are flexed during the attaching and detaching processes of the daughter board 20, excessive flexure of the latch members 120 is prevented by the stoppers 122 and, therefore, durability of the latch members 120 is enhanced.

Figure 8:
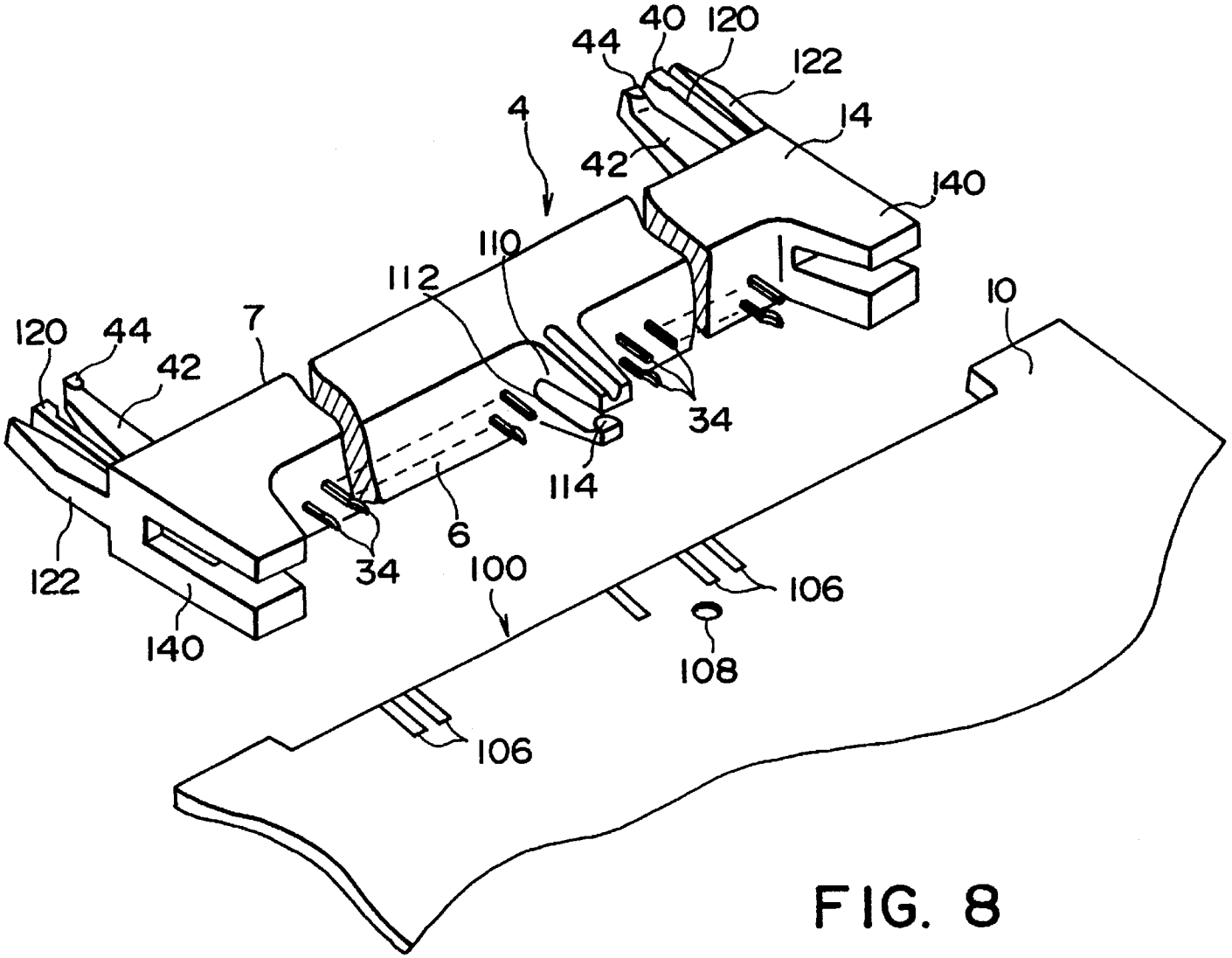
FIG. 8 is an exploded perspective view of an electrical connector and a board according to the fourth embodiment of this invention.

The fourth embodiment of this invention is illustrated in FIG. 8. The elements of this embodiment which are the same as those of the first, second or third embodiments are indicated by the same reference numerals.

An electrical connector 4 is the same as that of the third embodiment excepting that the pair of mounting members 140 have D different shape from that of the third embodiment. Each mounting member 140 constitutes a fork for holding the edge 14 of the mother board 10. These mounting members 140 allow the connector device 4 to be firmly fixed to the mother board 10 without using the shoulders 104 formed on the mother board 10 as in the third embodiment.

Figure 9:
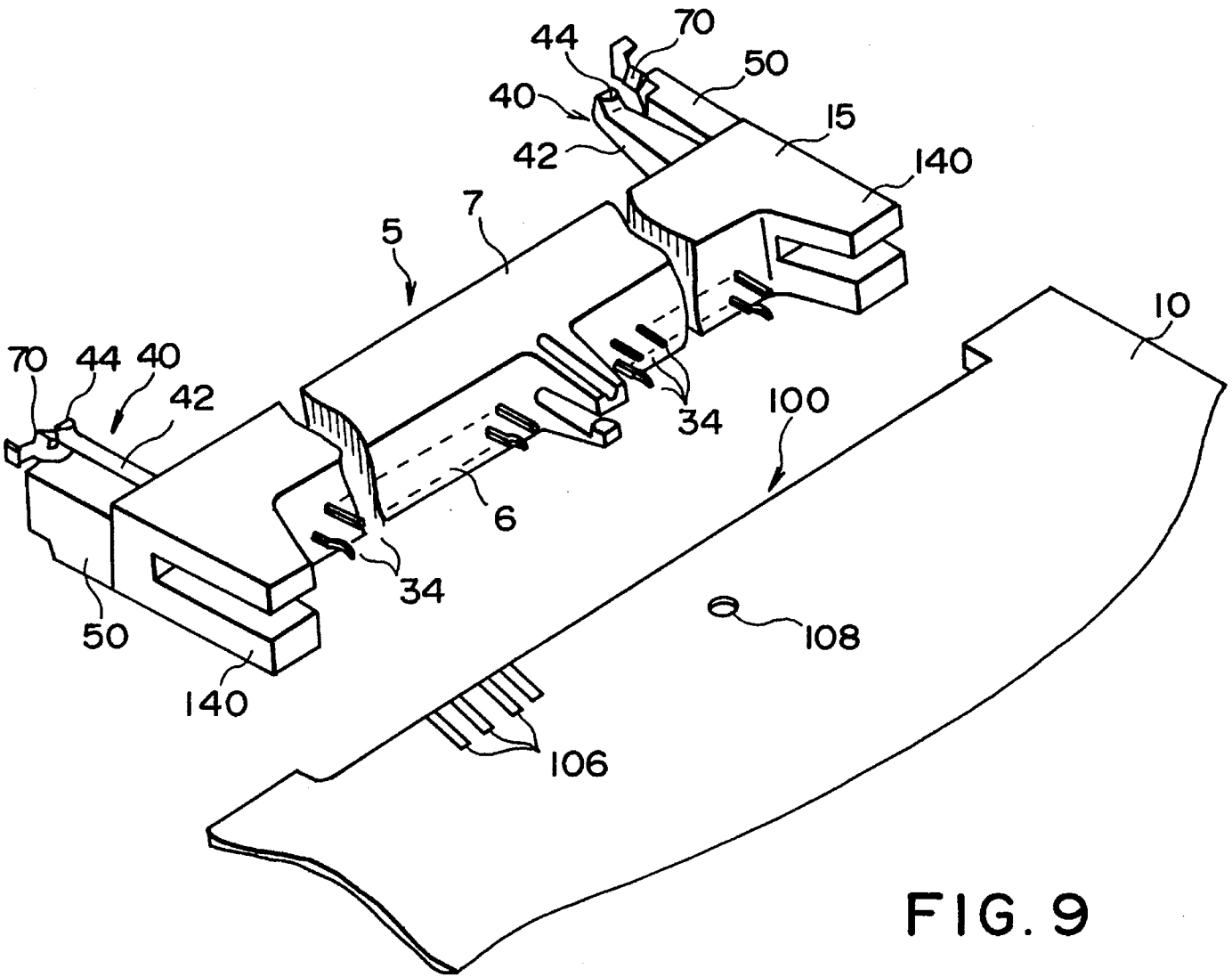
FIG. 9 is an exploded perspective view of an electrical connector and a board according to the fifth embodiment of this invention.

The fifth embodiment of this invention is shown in FIG. 9. The elements of this embodiment which are the same as those of the first, second, third or fourth embodiments are depicted by the same reference numerals. In electrical connector 5 of this embodiment, the plastic latch members 120 of the fourth embodiment are replaced by the metallic latch members 70 of the first and second embodiments. In other words, pocket members 50 are integrally mold-formed together with housing 15 on both ends of the second mount surface 7 of the housing 15. The metallic latch members 70 are inserted in the corresponding pocket members 50. The connector 5 is also made low in height, i.e., it has a low profile. The daughter board 20 is attached to and detached from the connector device 5 in the same processes as in the first and second embodiments.

This invention is not limited to the electrical connectors of the above-mentioned embodiments but is applicable to various modifications. For instance, the plastics latch members 120 of the third embodiment can be replaced by the metallic latch members 70 of the first and second embodiments. Reversely, the metallic latch members 70 of the first and second embodiments can be replaced by the plastics latch members 120 of the third and fourth embodiments.

In the second, third and fourth embodiments, bumps 36 (FIG. 1) similar to those of the first embodiment may be provided in the slot 30 to prevent the distortion and the bending of the daughter board 20.

Further, two or more slots 30 can be formed in the housing. In this case, a plurality of daughter boards 20 can be provided on a single connector device by inserting a pair of latch members or the like in each slot 30.

Since the flexure of the latch members are limited by stoppers, the connector according to this invention has the advantages that the durability of latch members are improved and a stable and strong holding force is maintained even if the attachment of a circuit board to and the detachment of the same from the connector are repeated.

Further, since that surface of the housing which faces the second circuit board is mounted on the edge of the first circuit board, the height of the assembly of the connector and the two circuit boards can be rendered low.

Accordingly, various modifications may be made without departing from the spirit or scope of the general inventive concept as defined by the appended claims and their equivalents.

What is claimed:

1. An electrical connector for electrically connecting a first circuit board to a second circuit board comprising:

an insulating housing having a first surface mountable on the first circuit board having a first and second side, the first surface having at least two opposed mounting legs for mounting the housing on the first circuit board where the mounting legs have a receiving portion for receiving one edge of the first circuit board and the first surface also having a retaining member extending from a location intermediate the two opposed mounting legs of the first surface for engaging at least one side of the one edge of the first circuit board and a second surface with a recess provided therein, the recess is dimensioned to receive one edge of the second circuit board therein and the second circuit board received in the recess of the housing extends along a direction in which the first circuit board extends, the second surface has a pair of supporting members for supporting the second circuit board to take a predetermined posture with respect to the first circuit board, the supporting members being provided on the second surface so as to face each other and sandwich the recess;

a plurality of contacts positioned in the recess for establishing an electrical interconnection to the second circuit board;

a pair of latches for latching the second circuit board and for releasing the latching of the second circuit board, said latches being positioned on the second surface of the housing so as to face each other and Sandwich the supporting members.

2. The electrical connector according to claim 1, wherein the one edge of the first circuit board received in the receiving portions of the mounting legs and the one edge of the second circuit board received in the recess of the housing are disposed opposed to each other with the housing interposed therebetween.

3. The electrical connector according to claim 1, wherein the second circuit board received in the recess of the housing extends along a plane in which the first circuit board extends.

4. The electrical connector according to claim 1, wherein the housing has at least two bumps which are provided so as press the second circuit board received in the recess of the housing to allow the same to take the predetermined posture.

5. The electrical connector according to claim 1, wherein the first surface has an upper and a lower retaining member extending from a central portion of the first surface for engaging both sides of the one edge of the first circuit board.

6. The electrical connector according to claim 1, wherein the retaining member has a boss which engages a hole in the one edge of the first circuit board when the one edge of the first circuit board is received in the receiving portion of the mounting legs of the first surface.

7. The electrical connector according to claim 1, wherein the latching means is detachably provided on the housing.

8. The electrical connector according to claim 7, wherein the latching means is a metal member which has the appropriate resilient characteristics to allow the latching means to be used over many cycles.

9. The electrical connector according to claim 8, wherein the limiting means is integrally formed with the metal member.

10. The electrical connector according to claim 1, wherein the housing is molded from elastmeric material.

11. The electrical connector according to claim 10, wherein the elastmeric material is high temperature plastic.

12. The electrical connector according to claim 10, wherein the latching means is integrally mold-formed on the second surface of the housing.

13. The electrical connector according to claim 10, wherein the limiting means is integrally mold-formed on the second surface of the housing.

* * * * *